US006821052B2

(12) United States Patent
Zurn

(10) Patent No.: US 6,821,052 B2
(45) Date of Patent: Nov. 23, 2004

(54) MODULAR, ROBOTIC ROAD REPAIR MACHINE

(76) Inventor: William Harrison Zurn, 602 San Conrado #1, Sunnyvale, CA (US) 94085

( * ) Notice: Subject to any disclaimer, the term of this patent is extended or adjusted under 35 U.S.C. 154(b) by 67 days.

(21) Appl. No.: 09/972,347

(22) Filed: Oct. 9, 2001

(65) Prior Publication Data

US 2003/0069668 A1 Apr. 10, 2003

(51) Int. Cl.[7] ..... E01C 23/06
(52) U.S. Cl. ..... 404/84.5; 404/101
(58) Field of Search ..... 404/84.05, 84.1, 404/84.2, 84.5, 84.8, 101, 100, 72, 90, 92, 95; 700/245

(56) References Cited

U.S. PATENT DOCUMENTS

| | | | | |
|---|---|---|---|---|
| 3,604,512 A | * | 9/1971 | Carter et al. | 172/4.5 |
| 4,216,838 A | | 8/1980 | Degraeve | |
| 4,473,319 A | * | 9/1984 | Spangler | 404/72 |
| 4,557,626 A | | 12/1985 | McKay | |
| 4,655,633 A | | 4/1987 | Somero | |
| 4,700,223 A | | 10/1987 | Shoutaro | |
| 4,899,296 A | | 2/1990 | Khattak | |
| 5,075,772 A | | 12/1991 | Gebel | |
| 5,294,210 A | | 3/1994 | Lemelson | |
| 5,323,647 A | | 6/1994 | Blanco | |
| 5,333,969 A | | 8/1994 | Blaha | |
| 5,362,176 A | | 11/1994 | Sovik | 404/72 |
| 5,439,313 A | * | 8/1995 | Blaha et al. | 404/75 |
| 5,447,336 A | * | 9/1995 | Deighton | 283/115 |
| 5,517,419 A | * | 5/1996 | Lanckton et al. | 701/216 |
| 5,549,412 A | | 8/1996 | Malone | |
| 5,556,226 A | | 9/1996 | Hohmann | |
| 5,614,670 A | * | 3/1997 | Nazarian et al. | 73/146 |
| 5,721,685 A | | 2/1998 | Holland et al. | |
| 5,752,783 A | | 5/1998 | Malone | |
| 5,996,702 A | * | 12/1999 | Hall | 172/4.5 |
| 6,520,715 B1 | * | 2/2003 | Smith | 404/75 |
| 2003/0055562 A1 | * | 3/2003 | Levy et al. | 701/214 |

FOREIGN PATENT DOCUMENTS

| | | | |
|---|---|---|---|
| WO | WO 9932725 A1 * | 7/1999 | E01C/23/01 |

OTHER PUBLICATIONS

"HDM Information Management System" Mar. 4, 2002.*
"Pavement Management Plans get help from Computer Programs", by Melanie L, Thrower, no date.*
Street Talk, vol. 14, No. 1 article entitled"Pilot Project to Link Pavement Management and GIS", 3/01.*
"Pavement Management System for Windows" by Dynatest, Feb. 21, 2002.*
Final Report entitled "Use of PMS Data for Performance Monitoring with Superpave as an Example", by Hudson, Monismith, Dougan, and Visser, Mar. 20, 2002.*

* cited by examiner

*Primary Examiner*—Robert E. Pezzuto
*Assistant Examiner*—Alexandra K. Pechhold
(74) *Attorney, Agent, or Firm*—Law Office of Alan W. Cannon

(57) ABSTRACT

A combination asphalt/concrete surface repair machine. The machine is a direction-finding, wheeled, transportable vehicle, which is a self-regulating, repair machine, controlled by a complex central computer. The machine is capable of being attached to and hauled by another faster vehicle (i.e., truck) if necessary. This machine is guided by a positioning device, which uses advanced radar and laser technology to place the machine above every position of the road surface to be repaired. The machine uses data from seismic or radar analysis carried out in preparation for repairing the road surface by the use of robotic modules within the machine. This technology can also be used to build new roads, racetracks, airport runways, sidewalks, driveways, parking lots, etc. Multiple construction or repair functions are provided within one machine.

17 Claims, 3 Drawing Sheets

MODULAR, ROBOTIC ROAD REPAIR MACHINE

FIELD OF THE INVENTION

The present invention relates to the field of machinery, and more particularly to machinery for repairing road surfaces.

BACKGROUND OF THE INVENTION

Road surface defects, including cracks, potholes, subsurface imperfections and other road nuisances, linked with road surface deficiencies, are experienced very frequently on highways, bridges and other paved surfaces such as airport runways or parking lots, especially where there is an extreme traffic pattern over the surfaces.

The center of attention regarding pavement engineering has changed from design and construction of new highways to preventive maintenance/treatment of the existing highways. A highway maintenance project is typically established on a visual condition survey. Regrettably, by the time indicators of corrosion are visible, major treatment is commonly necessary. If the inception of deterioration can be detected, the problem can often be resolved through preventive maintenance.

Traditional systems for renovating road surfaces necessitate a considerable quantity of labor-intensive activity to conduct the repairs. Even with this effort, the benefits of these repairs are sometimes short lived; the potholes, cracks, etc., appear again within a short period of time.

In addition to the problems of the road surface, motorists' spend billions of dollars each year for front-end alignments, shock absorbers, tire balancing, tires, etc. Furthermore, the traditional means of repairing roads are overwhelming with respect to the amount of time the customary traffic patterns are interrupted.

What are needed are improved methods and machinery to more rapidly repair road conditions and with better quality, long lasting results.

SUMMARY OF THE INVENTION

The present invention is directed to robotic, modular machines, systems and methods for efficiently repairing road surfaces.

A robotic, modular road repair machine is disclosed to include a movable vehicle having at least one slot defined by predetermined dimensions designed to receive a work module; at least one work module having predetermined dimensions adapted to fit within each slot, means for robotically moving at least one work module between a working position and an inoperative position; and means for controlling the means for robotically moving and for controlling actuation of said the at least one work module.

The road repair machine may further include a plurality of said slots and a plurality of work modules, wherein each said slot has the same predetermined dimensions and each work module has substantially the same predetermined dimensions.

The work modules may be interchanged among various slots. The means for controlling keeps track of positions of the respective work modules for controlling actuation of the work modules and controlling movement of the work modules between working and inoperative positions.

At least two of the work modules may have different functions. Various work modules may be employed, including radar/seismic module, sawing module, drilling module, asphalt filling module, level sensing module, sweeping module, tack coat module, concrete filling module, digging module, grinder module, rolling module, surveying module and crack and joint sealing module.

A road repair machine as disclosed may further include a machine engine for driving movement of the road repair machine.

Further, the road repair machine may include at least one hopper for containing a road repair material to be delivered to at least one of the modules for filling defects; and means for conveying the repair material from the at least one hopper to the at least one module. The at least one hopper may also be modular and may be interchanged among various locations in the machine.

A liquid storage tank may be provided in the machine for supplying liquid to at least one of the modules; and means for transporting the liquid between the liquid storage tank and the at least one module may be provided.

A system for efficiently repairing road surfaces is disclosed to include a relatively large machine including a movable vehicle having multiple slots, each defined by predetermined dimensions designed to receive a work module; multiple work modules having predetermined dimensions adapted to fit within each slot, and wherein at least one of the modules comprises a surveying module; means for robotically moving the work modules between a working position and an inoperative position; and means for controlling the means for robotically moving and for controlling actuation of the work modules; and a relatively small machine including a movable vehicle having at least one slot defined by predetermined dimensions matching the predetermined dimensions of the slots included in the relatively large machine; wherein the surveying module may be removed from the large machine and placed in a slot of the small machine to conduct surveying operations prior to road repair, and then removed from the small machine and replaced in a slot of the large machine for use during road repair operations.

A method of efficiently repairing a road surface is disclosed to include providing an electronic map of regions of a road surface to be repaired to a controller on board a repair machine; providing multiple work modules in the repair machine, said work modules having various dedicated work functions; positioning the repair machine to optimize a number of work modules that may be actuated simultaneously to perform work functions along the road surface to be repaired; and robotically controlling the work modules to perform repair operations in accordance with the electronic map.

The work modules are received in slots in the repair machine, and may be interchanged to optimize functioning of the machine.

At least one of the modules may comprise a surveying module, such as a radar/seismic module, and the surveying module may be placed in a second, smaller vehicle, and used therein to survey the road surface to be repaired prior to conducting repair operations with the repair machine having multiple work modules.

The electronic map used by the repair machine having multiple work modules may be generated from readings taking during the surveying operation.

At least one hopper may be provided to contain road repair material, and a transfer rate of the road repair material to at least one module may be controlled.

Further, monitoring of the amount of road repair material remaining in at least one hopper may be conducted, and estimates of time remaining until the at least one hopper needs to be refilled may be made.

The method may further include placing markers along the road surface to be repaired, prior to surveying and repair operations, wherein the markers provide reference points for both vehicles during operations.

Work modules may be interchanged as to their slot positions to optimize simultaneous repair operations.

These and other advantages and features of the invention will become apparent to those persons skilled in the art upon reading the details of the XXX as more fully described below.

DETAILED DESCRIPTION OF THE INVENTION

The present invention is directed to a combination asphalt/concrete surface repair machine controlled by a predominant, centralized computer, and guided by a positioning device which uses advanced radar, laser technology to position the machine on the roadbed. As improvements in positioning apparatus and radar, laser and seismic analyzer technology become available, they may be incorporated into later models/modules of this invention.

The invention incorporates three phases or processes:

Phase I

During phase one a survey team surveys the road surface, airport runway, parking lot, bridge, or area to be repaired. The survey team places reflective markers 1 to be used by the machine to guide and position itself during the analysis phase (Phase II) and repair phase (Phase III). Reflective makers 1 may be placed on the highway boundaries 2, for example. Reflective markers 1 are placed to allow optimum control & placement of the machine over the surfaces analyzed/repaired during Phases II and III. Reflective markers 1 provide reference positions to allow the robotic modules of the present invention to be precisely placed over the areas to be repaired.

Phase II

Figure 1:
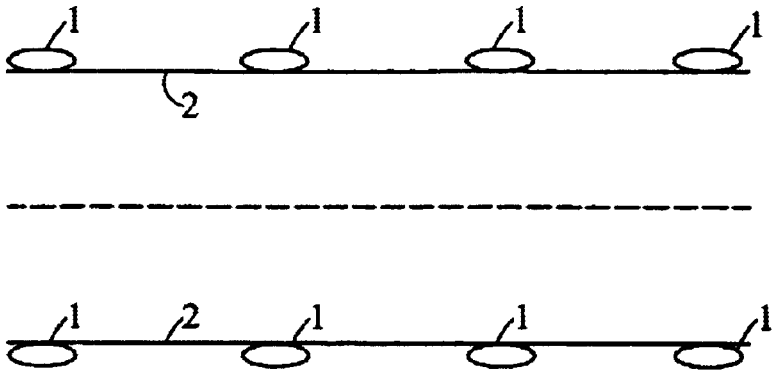
FIG. 1 is a schematic illustration of the placement of reflective markers along a road surface to be used as reference points by the present invention.
Figure 2:
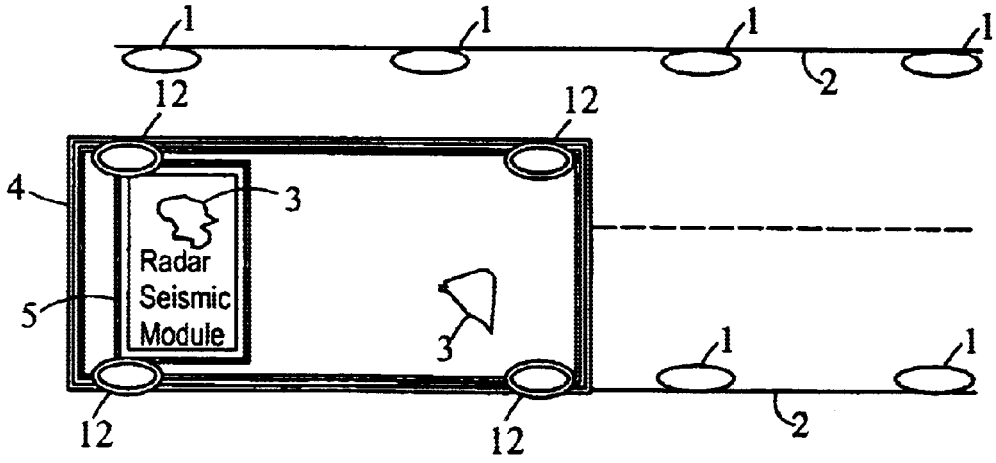
FIG. 2 is a schematic illustration of a small vehicle using a radar/seismic detection system module to analyze and record the defects in the road surface to be repaired.

During phase two, a small vehicle 4, uses radar/seismic detection system module 5 to collect data with respect to defects in the road surface. FIG. 2 shows vehicle 4 located to position radar/seismic detection system module 5 over a pothole 3 to analyze and record the characteristics of the pothole 3. The size, depth, location, etc. of the defect will be stored in the modules' computer. The stored data may be used for analysis and then for the actual repair of the pothole. Radar/seismic detection system module 5 can also be placed in a slot in a larger vehicle and used to analyze the road surface during and after repair of the surface. The wheels of small vehicle 4 are shown at 12. The analysis phase uses radar or seismic analyzer technology, or the like (each one of these technologies could be placed in a separate module depending on the technology or need) to collect data with respect to the defects in the road surface, airport runway, parking lot, or area to be repaired, and provides a three dimensional view of the defects.

During this phase, the longitudinal and transverse elevation contour of the road surface to be repaired is determined and set in an X-Y-Z equivalent format. This format may be consistent with technology such as: Geographical Information Systems (GIS) or Land Information Systems (LIS), for example.

Phase II is conducted to profile the requirements of the distinctive repair undertaking. The modular design of the robotic sub-system allows this. Determined by the varying necessities, radar/seismic detection module 5 may be used in Phase II, and then removed and placed in a slot in the lower level of the machine to be used in Phase III. This functionality allows for a less expensive vehicle (e.g., the smaller vehicle 4 shown in FIG. 2) to be used during Phase II, with only the modular radar/seismic unit 5 inside it. This saves time and expense which would otherwise require the larger, full scale machine with repair modules to be used during Phase II. One objective of the radar/seismic detection phase of the repair is to completely evaluate the characteristics of surface and subsurface situation data collected, which allows enhanced analysis compared to the long-established methods of visual assessment.

Hence radar/seismic module 5 is used during Phase II to carry out a recordation of the characteristics of the repair work required. The data collected during this phase is stored in a database to be used during the repair phase (Phase III). Additionally, the area to be repaired is subdivided into very small dimensions, e.g., one square inch horizontally, plus, up to three feet vertically (depending upon the technology available). These techniques allow the machine used during the repair phase to accurately repair the surface to a very fine detail. Analysis of the road surface often encounters various types of defects, including: cracks, indented regions, protrusions, potholes, etc.

Module 5 is constructed such (modularized) that it can be removed from the main repair vehicle 11 and used in Phase II in a light duty vehicle 4. After completion of Phase II, module 5 may then be removed from vehicle 4 and replaced in vehicle 11 for use during the repairs in Phase III.

Phase III

Between phase II and phase III, the data stored during analysis (Phase II), is reviewed by decision makers, e.g., civil engineers, material scientists, etc., as to how severe the road surface defects are. One or more decision makers then analyze and diagram a proposed solution. The proposed solution includes a map or diagram of the regions of the road surface in need of repair. This map or diagram (computer program) is used to instruct or guide the central computer 21 (repair machine 11 CPU 21) used during the repair phase (Phase III), as to how to repair the surface containing defects. One or more of the decision makers determine instructions which may include how deep to extract the openings, how wide to saw, what material to use, etc., with respect to every section of the surface needing repair.

Main repair vehicle 11 contains modularized, computerized, robotics instruments capable of performing operations that may include any or all of the following: grinding, grooving, leveling, sawing into defective segments, jack hammering to break surface material, compression hammer to compact material (e.g., asphalt), drilling into a defective segment, filling cavities with asphalt and/or concrete, and rolling of asphalt material, Additionally, main repair vehicle 11 is capable of removing concrete and/or asphalt from the defective segments by use of a backhoe type device and vacuum system. Further, main repair vehicle 11 is capable of placing reinforcing rods (cut to required lengths according to the diagram or map, by the associated module) and/or reinforcing screens into a segment to be repaired. The defective segments are filled with concrete or asphalt. Main repair vehicle 11 repairs bumps and waves by scarifying and re-compacting the surfaces to level the locations where the bumps and/or waves had existed prior to scarifying. Holes and depressions that occur in the existing surface are also corrected before resurfacing or prior to the placing of a leveling course. Main repair vehicle 11 also repairs spalled, scaled & map-cracked surfaces. Vehicle 11 may include a bump-cutter robotics module for work requiring that purpose. Further, main repair vehicle 11 may place crackseal material, petromat fabric, or double chip seal over the entire area under repair.

Central computer 21 is provided to control all of the above-described activities. The actions performed by the modules in main repair vehicle 11 are performed based on information collected during Phase II. Central computer 21 executes the mapping/diagram/analysis program, based on inputs from the decision makers (repair surface area mapped out), to schedule the work among the various modules, prioritize the processes, and turn over control to the modules to finish the tasks assigned. For example, with respect to a section of road ½ mile long, the machine may be assigned over fifty different tasks.

Central computer 21 determines the most efficient schedule algorithms to complete the tasks in the most efficient timeframe. For example, main repair vehicle 11 may have three modules working independently on three different jobs, such as, one module is sawing, one module is drilling, and one of the modules is filling a segment with asphalt. In this case, this is only possible if the machine is in a location such that each module's robotics arm can reach the task site they are assigned to. Otherwise, central computer 21 must schedule one task and then move the machine to the next location.

Each of the modules for performing the functions described above are built by means of obtainable, existing hardware and will be customized into individual, self-contained, standard sized, easily removable, easily serviceable modules. Each of these modules are generally built to have the same dimensions, to allow interchangeability in the different slots. This interchangeability of the modules into different slots of the lower level of the instrument permits main repair vehicle 11 to flexibly meet various road surface repair requirements.

Module 5 may be removed from vehicle 4 after completion of Phase II (if the customer chooses) and be placed in main repair vehicle 11 to perform Phase III) to be used to determine if the individual road segments have been adequately repaired. A very important aspect of this invention is the ability to place different types of modules in the machine for repairing road surfaces requiring different types of modules or different types of asphalt and concrete blends.

Regardless of the location of a specific repair module, central computer 21 keeps a record of the current locations and identifications of the modules in the lower level, even when a module is removed and placed in a different slot. By providing a standard size for the module slots, modules may be moved and interchanged to any slot in the lower section of the machine 11. The size of machines 11 will vary regarding the number of slots for modules, some large-scale machines 11 will contain slots for fourteen modules, for example, and smaller versions may contain only 6 modules. However, the present invention is not to be limited only to main repair vehicles having six slots or fourteen slots, as other variations having different numbers other than six or fourteen may be designed in accordance with the principles described herein. With more complex repair projects, that is, a project needing concrete repair, asphalt, replacing steel rods, etc., larger machines with more modules may be required.

Figure 3:
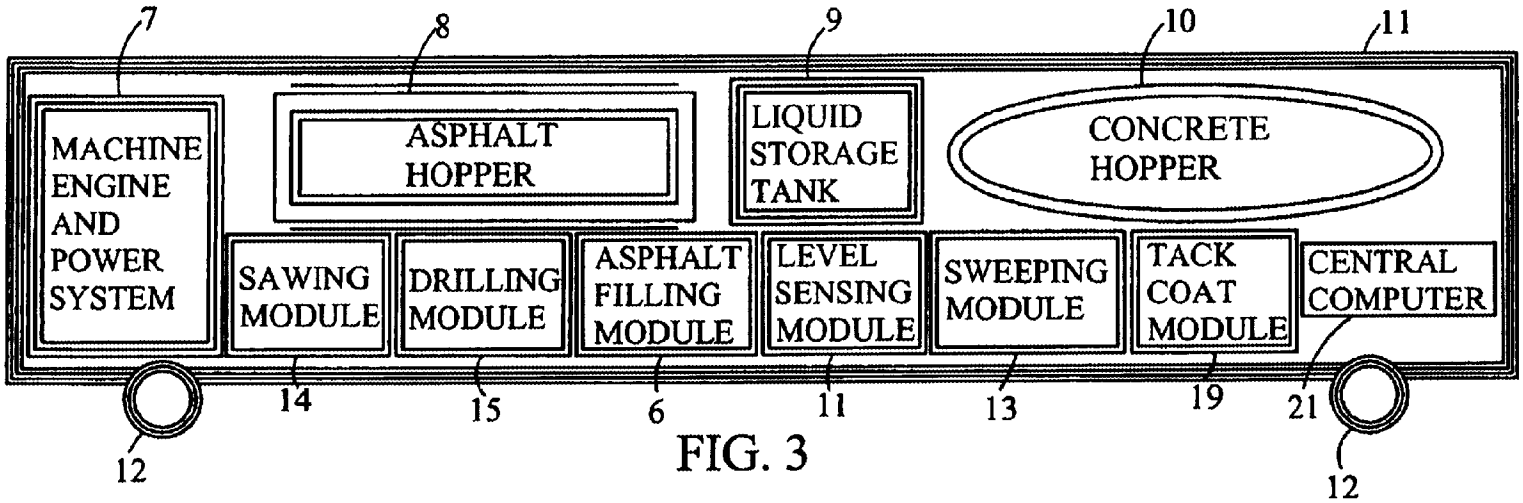
FIG. 3 is a side, schematic view of a road repair machine according to the present invention.
Figure 5:
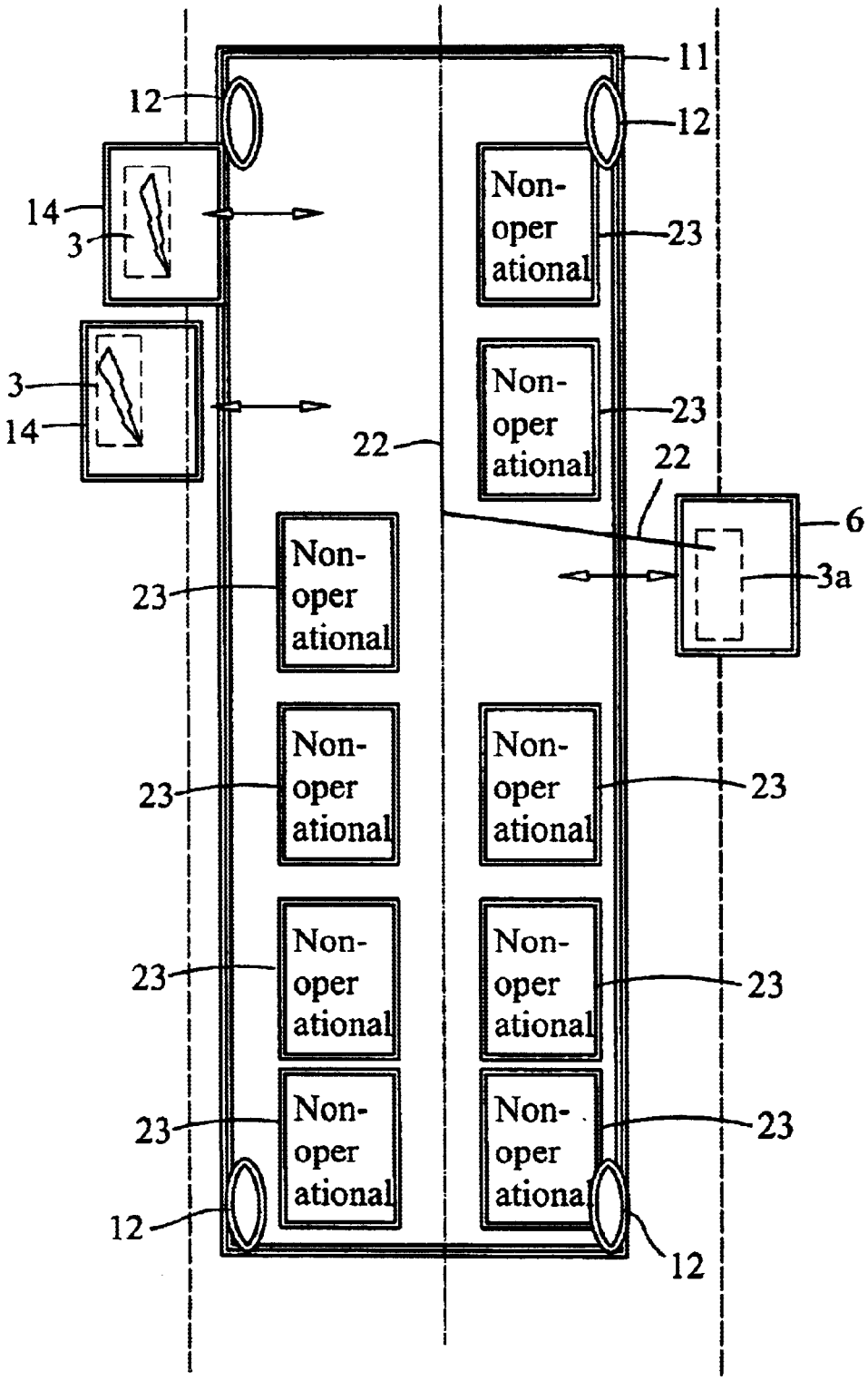
FIG. 5 is a schematic representation of a road repair machine performing repair operations according to the present invention.

Additionally, all of the robotic modules described will be located on the lower level of the machine 11 (see FIG. 3), whether currently operational or non-operational (see FIG. 5). The upper level of machine 11 contains the hoppers needed to hold the concrete, asphalt mix, liquid storage tanks, etc. Also a hopper can be used to collect debris removed during the repair.

Figure 4:
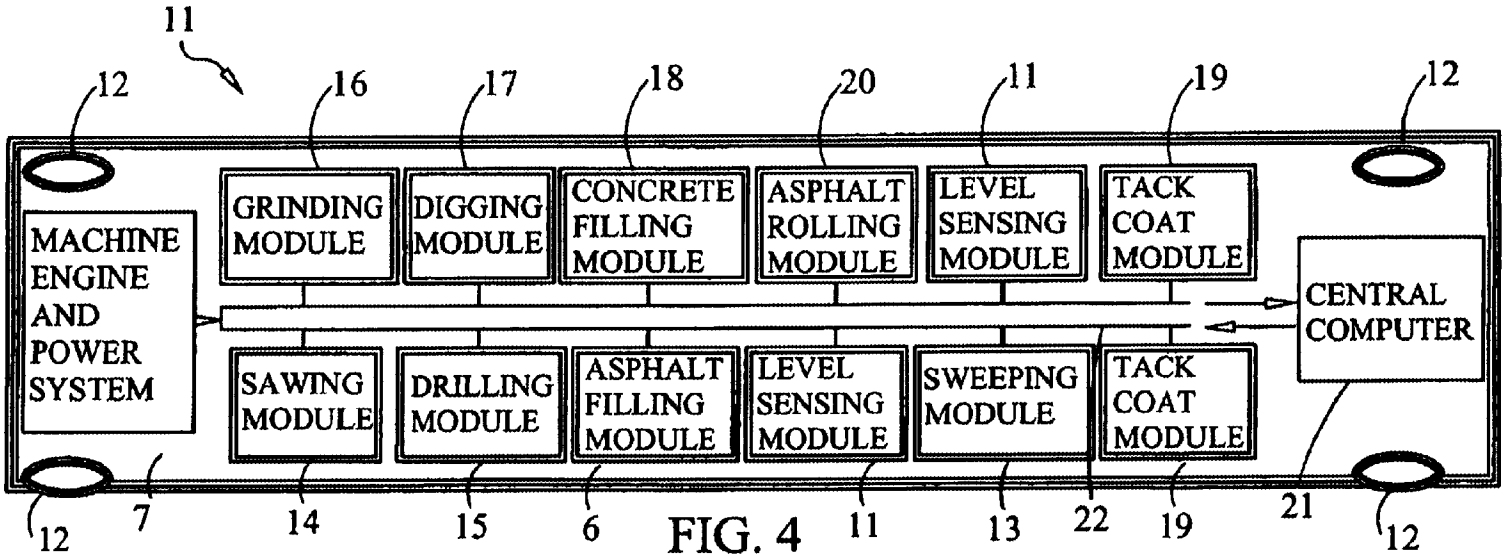
FIG. 4 is a top, schematic view of a road repair machine according to the present invention.

Between the upper level (hoppers, storage tanks) and the lower level modular housing structures (sawing devices, compression hammers, etc.), there is a conduit type area that contains CPU busses to the modules, air lines, power lines, etc. (see FIG. 4) Conduit area 22 connecting the central computer 21 and control to the hoppers, tank and modules also contains the various conveyer systems for moving the asphalt/concert material to the filling modules. Various repair modules 16, 17, 18, 20, 11, 19, 14, 15, 6, 13 are also designated in FIG. 4. The hoppers may also be modular, to allow different configurations based on customers' needs.

The front of the machine 11 contains the power 7 (engine power and to power the all of the robotic repair modules) unit, and the rear of the machine 11 contains the central computer 21.

The dimensions of some types of the repair machine 11 will be such that no special permits are required; that is, it can be transported on any public highway, street, etc. Larger machines 11 may need special permits to transport them on the highways. The machine 11 is capable of being attached to and towed by another faster vehicle (i.e., truck) if necessary, when being transported between road repair projects. The machine 11 is a course-plotting, wheeled, portable vehicle, which is a self-determining, repair mechanism, controlled by a central computer 21.

The machine 11 is capable of moving and positioning itself, without the need for external power. The machine 11 not only positions itself, but also analytically adjusts the positioning of each of the separate robotic modules over the areas to be repaired. This feature permits the machine to perform more than one function at a time, possibly three or more functions at once (e.g., see FIG. 5), depending on the proximity of the robotic arms and the area to be repaired. The multi-task computer 21 determines whether this is achievable or not. The machine 11 has hoppers, in which the asphalt/cement is loaded periodically as required. The machine uses advanced radar, seismic technology module 5 to analyze the road surface with respect to the defects in need of repair. This analysis includes irregularities, bumps, cracks, voids, and cavities.

The Central Computer

Central computer 21 may be purchased off the shelf, from currently existing computer suppliers, or may be designed specifically for the road repair machine 11 by engineers and scientists as an instrument for performing the technical tasks and computational problem solving algorithms required by the road repair machine 11. Preferably, central computer is designed based on existing, off-the-shelf hardware components, standard interfaces and peripherals, and combined with an advanced version of a multi-tasking operating system. Central computer 21 must be able to support a variety of application programs concurrently running on auxiliary robotic repair module processors.

Central computer 21 provides road repair machine 11 with dedicated compute power close to the modules required for the various road repair activities desired. Using the abilities of a multitasking operating system, central computer 21 gives machine 11 the capability to run application programs on more than one repair module at a time. Central computer 21 organizes the jobs to be performed in a sequence so as to allow machine 11 to optimize movements to reduce any unnecessary passage, thereby minimizing the time required to complete the total repair. Computer 21 runs software programs effectively and efficiently. System software and interface hardware both need to be seamlessly distributed from the computer. Fortunately, the multi-tasking operating system makes this possible.

The multi-tasking operating system of computer 21 may include any stable, reliable and inexpensive operating system for running application programs. The operating system is also adaptable and modifiable for developing application programs used to operate the modules in the processes referred to above. The operating system smoothly interfaces with the current and planned robotic module hardware designs with fast busses or wireless communication.

In addition, the multi-tasking operating system accommodates software programs and tools to help with development of software applications. Included are the 'C', 'C++' Fortran, ADA and Pascal compilers, many library routines, and networking software to allow users to share resources and data. These are important in meeting all robotic module software needs used in conjunction with the central computer 21. The same type of central computer 21 used in the road repair machine 11 may be used to develop application programs off-line.

The main hardware needs for central computer may include at least one 64 or 128 bit processor, adequate memory and disk storage, standard network and communication interfaces, upgrade flexibility and ability to easily add new peripheral devices. Over time, as better hardware components become available, faster designs can be incorporated into new central computers —transparently, as the multi-tasking operating system will 'hide' these changes from users and their programs.

Central computer 21 and its multi-tasking operating system are configured to run existing application programs (either developed by the customer or purchased externally) and are adaptable to operate when newer computer products are purchased to keep overall costs to customers as low as possible. The multi-tasking operating system is thus based on an open and nonproprietary design, and beneficially provides many software tools and utilities, easy configuration for new hardware peripherals, virtual storage capability, and good networking ability. Use of industry standard I/O interfaces means customers will decide on their own solutions for external peripheral component needs.

Using 'off the shelf' hardware to build a central computer 21 has several key advantages, including minimizing the risk of any schedule impact due to design or part delivery problems, designs are more likely to support enhancements and upgrades over a long period of time, and lower prices from using mass produced components. Off-the-shelf components that may be employed include: CPU and memory chips, power supplies, assembly components, etc.

Minimizing the use of proprietary hardware designs and interfaces helps to achieve faster design cycles and reduces the time required to place new products into the market. This greatly assists in maintaining upward compatibility of the user's hardware components. This greatly increases the market user-friendliness of the road repair machine 11.

The multi-tasking operating system maintains a stable user software programming interface. Multi-tasking software also provides a very adaptable and flexible capability for adding any new or improved hardware components with little or no impact to existing system programs. Software upward compatibility is preserved for customers.

Road Surface Analyzer

One of the most essential features of the road surface repair machine 11 is the technology required to analyze the roadway, airport runway, parking lot surface, etc., to be repaired for defects, faults, flaws, etc. This technology will transform and evolve with time, and the modules containing the technology will be altered accordingly. As new technology is developed, these changes will be incorporated into the latest revisions of modules with-in the machine 11. As of now, the technology will be referred to as the radar/seismic detection system 5. This technology is available at this time.

The radar/seismic detection system 5 (used in the equipment in Phases II and III), placed in one of the modules, is capable of appraising all types of transportation structures/surfaces, including highway asphalt/concrete road surfaces (including bridges), airport runways, and parking lot surfaces. The purpose of these assessments is to support the determination of maintenance, preparation requirements and to provide the best possible reconstruction quality examination of the surface to be repaired.

The application of the assessment technology is customized to the requirements of the distinctive repair undertaking. The modular design of the robotic sub-systems allows this. Depending on the varying requirements, the radar/seismic detection module 5 can be placed in a slot in the lower level of the road surface repair machine 11 or be removed quickly and efficiently. One objective of radar/seismic detection phase of the repair is to optimize the quality of subsurface condition data collected over long-established methods of visual appraisal.

The radar/seismic detection system (module) 5 is capable of identifying the number and thickness of each layer in a multi-layer pavement arrangement. Data can be collected while the machine 4 or 11 is moving up to 15 miles per hour. The module 5 determines the number of layers that are identifiable, provided the proportional dialectic constant of adjacent layers is different. For example, tow lifts of asphalt or older multiple overlays may not be discernible. The radar/seismic study may provide an uninterrupted outline of layer thickness, thereby determining consistency of the underlying foundation.

Air voids as small as 0.125 inch in thickness, can be recognized using the radar/seismic detection system 5. Identifying these areas and repairing them in a timely manner will avoid costly broken slab replacement. Enhanced quality control of grouting actions with pre and post-grout examination can be achieved. Radar/seismic subsurface examinations can be combined with other data to more precisely characterize individual project remedy necessities or all-purpose treatment approaches for repair of the roadway system.

Radar/seismic system 5 may have several data acquisition modes, including continuous contour profiling and point stacking, allowing the system to put together optimum data continuity throughout the entire contour of the roadway.

Radar/seismic system 5 also effectively identities moisture induced stripping of the asphalt cement from the combined surfaces which leaves an unbound aggregate mixture. With the detection of these areas, output of remaining life estimates and other computerized mechanistic models are improved. The decision to overlay or reconstruct may also be affected by the presence of stripping. Other repair efforts may be designed more cost effectively when the full extent of the stripping is known, which is provided by radar/seismic system 5.

Radar/seismic system 5 is capable of determining the condition of concrete under an asphalt covered surface, and can also analyze for any occurrences of debondment of the overlay under all circumstances. Further, radar/seismic system 5 establishes the position of reinforced steel, when present, and quantitates the amount of moisture in concrete pavement. Radar/seismic system 5 is further capable of determining the location and quality of delaminated concrete, the depth of the reinforcing steel and the thickness of a bridge deck when analyzing road surfaces over bridges. In the cases of replacement of the reinforced steel, the radar/seismic module 5 ascertains the correct placement of the reinforced steel rods with-in cavities.

In addition to the radar/seismic technology within module 5, the technology to provide an alignment laser beam emission system to direct a reference laser beam to provide leveling information may be contained within module 5. Multiple optical beam splitters, mounted near the vicinity of each of the pavement sensors/reflectors may be aligned to capture an orientation laser beam emitted from an alignment laser beam emitter. Sensors/reflectors 1 are placed by the survey team during phase 1, as noted above.

Radar/seismic system may be adapted to determine at least the following circumstances: moisture in the base layer, voids or loss of support under joints, overlay delamination, fine cracking, and pavement aging. The radar/seismic technology provides an extraordinarily concise illustration of the roadway surface to be refurbished, and makes- a complete structural assessment of the region to be renovated. The structural assessment/appraisal authenticates liner thickness, existence of nonappearance of voids, rebar positions, malformed rock/soil configurations, foundation locations, and reinforced steel locations. By providing a comprehensive representation of the roadway to be repaired, radar/seismic module 5 enhances the ability of machine 11 to more successfully and efficiently repair the surface under evaluation.

Modular Design of Road Repair Robotic Units

Another important feature of the present invention is the modular design of the robotic repair units. As noted above, each module is designed to have the same dimensions (e.g., approximately 4 feet by 6 feet by 4 feet, although the invention is not limited to these dimensions), which permits the placement of any repair module into any slot of the lower level of the machine. Central computer 21 recognizes the location relationship of each module (with respect to positioning the module over the repair area) in machine 11 regardless of which slot in the lower level the module resides.

This feature gives machine 11 flexibility regarding altering the placement of the repair modules in machine 11 based on the changes required because of different road surface repair needs. The modules will utilize technology that is already available, but, must be re-engineered to fit into the standard sized module slot in the lower level of the machine 11. Also, light service vehicle 4 is provided with one or more slots having the same dimensions as those provided in vehicle 11. An example of a module (which is used in both type vehicles, as noted above) is radar/seismic module 5. The technology for performing the radar/seismic tasks exists, but this technology is engineered, reduced, redesigned, etc., to fit into one of the module slots.

The repair modules include ball rollers, or similar technology that allow the repair modules to be precisely positioned over the areas to be repaired. This allows the module to be moved in any x or y position unhindered and relatively effortlessly.

Using these standard sized modules, machines 11 with different numbers of modules can be built. Some machines 11 will be built requiring fourteen slots or modules, whereas some machines will not need that many modules and will be built with six or eight slots or modules. Machines 11 having other numbers of slots are also possible. A machine repairing asphalt roads may need only six modules.

The upper level hoppers (e.g., see hoppers 8 and 10 in FIG. 3) also utilize a modular design, accommodating two to four asphalt hoppers 8 or a combination of multiple asphalt 8, concrete hoppers 10 or debris holding hopper, this in case the road surface is a combination of asphalt/concrete material. The upper level also may include storage tanks (also modular) for liquid material, such as liquid storage tank 9 shown in FIG. 3, for such uses as applying a tack coat to vertical and horizontal surfaces required during certain phases of the repair operation.

Further, the upper level may contain water tanks used for the concrete saws, grinders and other equipment that require water for cleaning, cooling, etc. These upper level hoppers will have a delivery system, that is, conveyor belts (asphalt/cement), tubing (liquid material), allowing the transfer of asphalt/concrete or liquid material from the upper hopper level to the appropriate lower level modules. The upper level may also have a hopper to hold the debris material removed from cavities under repair.

Asphalt Hopper

A standard technique of repairing high quality surfaces for roads, airport runways, parking lots and other surfaces, is by means of the application of mixed paving materials such as bituminous slurry. The manufacture of bituminous slurry, as with virtually all paving materials, requires the mixture of several ingredients. The quality of the bituminous slurry or other road surface paving material is directly reliant on the comparative amounts of these components.

Present-day paving systems rely on calibration procedures to approximately estimate the amounts of the various ingredient parts of the paving material mixture. These calibration techniques do not provide response as to the quality, uniformity or formula of the paving material being produced as it is shaped.

Other present-day techniques allow for an operator of the machine to regulate the uniformity of the paving material combination at the job site based on visual inspection of the paving material as it is combined. These techniques require exceedingly skilled operators to be able to judge the suitable formula of the mixture and make the necessary regulation. In addition, the current techniques require constant scrutinizing and may cause variability in the characteristic of the paving material.

One of the principal factors in the operation of the asphalt hopper 8/asphalt delivery system is to provide the asphalt-filling module 6 with a controlled application rate of material. Absent finishing an entire batch of road surface paving material, present-day techniques do not have any way of determining this "treatment swiftness", which is usually measured as the weight of dry material used per unit area covered. Contemporary techniques weigh the amount of material at the beginning of the job and after the material has been used for the job, the over-all supply is measured to determine the amount of asphalt material used. This process doesn't allow delicate regulation as to the use of the repair material during the application of a batch of asphalt substance.

Currently known techniques for road surface repair require an operator to facilitate the correct rate of application of the asphalt material by visually rendering the application process. Thus, no feedback is provided with respect to the application of material for the duration of the process. In contrast, the present invention includes sensing devices within hopper 8, along the asphalt delivery system, and within asphalt-filling module 6, to provide feedback to central computer 21 regarding the amount of asphalt within the total system. The machine's 11 delivery monitoring system constantly checks the uniformity and the application rate of the asphalt paving material during application of the asphalt.

Central computer 21 constantly monitors the amount of asphalt material in hopper 8, within the delivery system, and within asphalt-filling module 6 to determine when asphalt hopper 8 is in need of refilling.

Further, central computer 21 estimates an amount of time remaining until the refilling of hopper 8 will be required, so as to allow the trucks carrying the asphalt material ample time to arrive at machine 11 to refill asphalt hopper 8. In a situation where two very dissimilar asphalt materials are required, machine 11 may be fitted with two hoppers, one for each type of material, again the flexibility of the modular structure of the machine allows this depending upon the road surface repair needs.

Repair Material Conveyor

The repair material conveyor system includes high response rate sensors along the conveyor delivery system to provide monitoring signals, as to the nature of the repair material (asphalt/cement), thereby keeping central computer 21 informed as to the temperature and amount of material on the material conveyor. The temperature and amount of the material delivered can be changed within the limits of the heater/cooler and belt speed/capacity. Due to the rigorous system, the repair material (asphalt/concrete) can be delivered to the filling robotic modules with the correct temperature and the precise amount.

This ability indicates that such a feedback mechanism may be made to control a combination of factors of the material feed operation of the road repair machine, such as, the speed of the conveyor belt, control of the heating/cooling of the material, the amount of material released by the hoppers (asphalt/cement), etc.

Asphalt and Cement Filling Modules

The asphalt and cement filling modules 6 and 18 can determine the characteristics of the craters to be filled (based on information stored in central computer 21), distinguish cavity measurements, and packing levels. During Phase II, the analyst(s) (civil engineers, material scientists) will determine what materials are needed for each cavity and program central computer 21 accordingly. With respect to road surfaces of a combination of concrete and asphalt, machine 11 may be equipped with both concrete filling module 18 and asphalt-filling module 6.

The modules 6,18 control the dispensing of the asphalt/concrete material. Each module 6,18 includes a mounting device (over the cavity) to control the temperature of the asphalt or concrete filling material. The filler materials may be dispensed consecutively to provide dissimilar types of filler material (by the asphalt or cement filling modules 6,18) if necessary (stored in different hoppers on the second level). For cement filling, the cement is placed in the cavity, spread out within the cavity, leveled by the leveling module, and left to dry.

Machine 11 may use quick drying concrete, allowing for the most time efficient repair process possible. The excess cement (after leveling) is left near the cavity to dry, and can be swept away later, either manually or with a more complex device, a sweeping module.

Regarding asphalt-filling requirements, after module 6 directs the material, that is, the material is placed in the cavity, the filling module robotic filling apparatus is moved away from the cavity site. The radar/seismic module 5 (the same module used during phase II) may contain a sensor to determine the amount of asphalt material in the cavity and how the material is placed in the cavity.

The modules (filling and radar/seismic 6,5) are switched until the proper amount of material is placed in the cavity and compacted to the optimized mass. Each time the filling module 6 directs material into the cavity, it controls the position and dispensing plunger as well as the heating and flow of filler materiel within the cavity to be repaired, storing this information in the central computer 21 to be used later. Another aspect related to this is using a very quickly setting asphalt repair patching material.

After the cavity is filled, the filling module 6 is shifted away from the cavity and the compacting or rolling module 20 is used to condense the material to the proper degree. To fully optimize the filling of the cavity, several operations amongst the filling module 6, radar/seismic module 5 and the compacting/rolling module 20 may be necessary before the cavity is properly filled.

Digging Robotic Module

The digging robotic module 17 (see FIG. 4), a device similar to a backhoe, is customized to fit within the module slot, and may use existing technology for its operational components. Digging module 17 is adapted to remove the debris from the cavity in which the repair is to take place. The debris is transported to a hopper, which holds the material until it can be off loaded to a truck. Digging module 17 may have sensing technology to determine if all of the debris material has been removed from the cavity, this information will be communicated to the central computer 21, indicating when the job is completed.

Drilling/Jackhammer

The drilling/jackhammer module 15 is adapted to perform operations required to drill and jackhammer the surface under repair.

Grinder Module

The grinder robotic module 16 is configured to take rough spots out of concrete surfaces within a short time, as well as all types of road surfaces, asphalt/concrete roads, bridges, sidewalks, and patios. Grinder module 16 functions to clean, level and smooth bumps and uneven areas, and remove paint spots, epoxies or any other type of material on the road surface.

Grinder module 16 is very compact and easily adjustable for all types of cleaning, grinding and feathering. Like the other modules discussed, grinder module fits within the standard-sized slot (e.g., a 4'×6'×4' slot) located in the lower level of machine 11. Grinder module 16 may have sensing capability to establish whether all of the surface material has been removed from the surface that is scheduled to be removed, and this information is communicated to the central computer 21, indicating when the job is completed.

Sawing Module

As noted earlier, an important feature of this invention is the modular design of the repair robotic units; each module will be of the same size (e.g., 4' by 6' by 4'). This permits the placement of any repair module in any section of the lower level of the machine 11. This aspect gives the machine 11 flexibility regarding altering the placement of the repair modules in the machine 11 based on the changes required because of different road surface repair requirements.

The sawing modules 14 may have several types of asphalt/concrete sawing blades. For example, a module 14 for a certain requirement may contain a 14" sawing blade and a 48" sawing blade. Another sawing module 14 may contain three blades, again, depending on the road surface repair requirements. All robotic sawing blades may include a shaft tachometer and a cutting depth indicator. Additionally, the robotic arms may be rotatable, to allow each blade to enter a cut at up to a 20-degree angle, for example.

Electric saws are preferable over pneumatic saws, although pneumatic saws may be employed. Electric saws offer the ability to saw with no fumes, and provide more power at the blade shaft, reduced blade RPM fluctuation, and vibration, and reduced sawing noise, when compared with pneumatic saws of the same dimensions. With some applications, air compression saws would be preferred however, and the sawing modules may be customized to accommodate this type of saw.

It is also preferable to use turbo blades that are designed to be smooth cutting with advanced high-density metal bond technology and high diamond concentration. This type of saw blade provides for long life and smooth cutting in the widest range of materials, which is beneficial for use with roadbeds which may contain a variety of materials, such as a combination of concrete/asphalt and reinforced steel, as already noted. A sawing module 14, configured as described can readily saw through concrete, metal, asphalt, masonry, stone, iron rods, etc. Robotic saw module 14 may include an audible warning or "prevent use" condition if a blade is mounted incorrectly, which would protect it from damage or destruction as well as injury to bystanders.

Sawing module 14 may include a water disc distributing system, which would make water available evenly to the blade, ensuring maximum cutting capacity and effective cooling. The blade drive unit is easily accessible for servicing; and the engagement and support rollers provided are easily removable for trouble-free replacement.

Robotic Rolling Module

The machine's 11 robotic rolling modules 20 contain a weight deflectometer for examining the deflection of the pavement surface under repair. The deflectometer incorporates an alignment laser beam emitter that measures vertical displacement of each of a group of distance sensors mounted on a horizontal sensor bearer within the module that changes direction or vibrates as it is transported over a road surface for deflection measurement. This alignment laser beam emitter works in conjunction with the sensors placed by the survey team during Phase I. This process allows measurement of the vertical displacements. The technology for this module is already in use for other road surface repair purposes and are customized for use herein in the standard sized machine robotic modules 11.

Rolling module 20 makes available a rolling weight deflectometer, and measurement system for such a deflectometer, that compensates for inaccuracies in deflection. Several versions of rolling modules 20 may be provided, some modules 20 with smaller sized rollers than others. For example modules having 6 inch, 12 inch, and 18 inch rollers may be provided. Other roller robotic modules 20 may have larger rollers, for example: 12 inch, 24 inch, and 36 inch rollers. Each roller module 20 generally will have no more than three rollers. The magnitude of the road repair project will determine what sized rollers (modules) are inserted in the lower level slots of the machine 11. In some cases, the machine 11 may contain two roller modules with different sized rollers.

In order to determine pavement condition for airport runways or highways, the load bearing capability of the pavement is occasionally tested. Load bearing capability may decline in due course, as a result of a number of reasons, including alteration in the elastic moduli of sub pavement layers of the sub-surface. Sub pavement earth layers subside or swell, their moduli are altered and affect the stability and load bearing capability of an overlying pavement.

With the intention of measuring the load bearing capability of the pavement, it follows that making use of technologies that are nondestructive must be used so as the reliability of the pavement layer is preserved. In addition, the measurements will be made as rapidly as possible, by means of the rolling module 20, to lessen the repair period and further reduce expenses.

Rolling module 20 provides a load on the rolling device, which rolls across the pavement and the depth of a deflection basin created by the loaded wheel is measured using precision laser sensors mounted on the module 20, plus, using the sensors placed by the survey team during phase I. Such deflection measurements provide insight into the load bearing capability of the pavement. The pavement deflections are usually very small, typically 0.010 to 0.040 inch for a 20,000 pound applied load. Because of this fact, very sensitive sensors are required to measure the deflection.

Rolling module 20 provides a rolling weight deflectometer, plus a manipulating system that automatically balances for sensor bearer member bending. This rolling module 20 provides self-controlled member bending, for more precise measurements of pavement deflection under an applied load.

Crack & Joint Sealing Module

Most of the resources used in road surface construction have moisture susceptible rigidity. The rigidity of the surface diminishes as the moisture content of released granular materials and soils increases. Moisture leads to damage of asphalt concrete due to maturing, stripping, and adverse climate conditions. Water under Portland cement slabs can build up to very high pressures, wearing away the base and subbase materials. Crack and joint sealing aid to prevent such deterioration of the surface by reducing the infiltration of moisture from the surface into the pavement structure.

An engineer will normally use visual methods to review the obvious condition of cracks and joints to determine if crack and joint sealing is suitable. Most engineers will not seal a crack until it is greater than 5 mm wide. If the amount of deterioration resultant from moisture at the joints and cracks could be determined, this information could help establish when crack and joint sealing is desirable to diminish the infiltration of moisture.

The engineer typically looks for signs of weathering, raveling and the occurrence of a composition of fine cracks that can be sealed with the surface seal. If the presence and level of aging could be determined, the damage to the asphalt because of aging could be stopped or diminished. If the dilapidation of paving materials because of nonstandard moisture levels in the asphalt and supporting layers or fine cracking could be determined, the requirement to position a blockade to reduce penetration of water into the structure could be appraised.

The crack/joint-sealing module or tack coat module 19 receives information from the analysis conducted in Phase II, and stored in the central computer 21, to repair those cracks and joints determined necessary by the civil engineering and maintenance personnel. By doing so, the surface seals will extend the life of pavements by improving the surface roughness of the pavement, by reducing weathering, raveling, and decreasing the infiltration of moisture into the pavement structure.

FIG. 5 shows the machine 11 performing repair operations. The sawing modules (14) are sawing into the asphalt over two potholes (3) simultaneously. The asphalt-filling module (6) is filling the pothole (3) below its module. The modules have been moved outside of the main structure by robotic arms to perform these operations as indicated by the double arrows. Most repair modules are at their non-operational position (23) and not used at the time.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

What is claimed is:

1. A robotic, modular road repair machine comprising:

a movable vehicle having at least one slot defined by predetermined dimensions designed to receive a work module;

at least two work modules each having predetermined dimensions adapted to fit within each said slot, wherein a first of said work modules is capable of being removed from one of said at least one slots and being replaced by a second of said at least two work modules;

means for robotically moving said at least one of said work modules between a working position and an inoperative position; and means for controlling said means for robotically moving and for controlling actuation of said at least one work module.

2. The road repair machine of claim 1, further comprising a plurality of said slots and a plurality of said work modules, wherein each said slot has the same predetermined dimensions and each said work module has substantially the same predetermined dimensions.

3. The road repair machine of claim 2, wherein said work modules may be interchanged among various slots, and wherein said means for controlling keeps track of positions of said respective work modules for controlling said actuation of said work modules and said movement of said work modules between working and inoperative positions.

4. The road repair machine of claim 2, wherein at least two of said work modules have different functions, said work modules being selected from the group consisting of: radar/seismic module, sawing module, drilling module, asphalt filling module, level sensing module, sweeping module, tack coat module, concrete filling module, digging module, grinder module, rolling module, surveying module and crack and joint sealing module.

5. The road repair machine of claim 1, further comprising a machine engine for driving movement of said machine.

6. The road repair machine of claim 1, further comprising at least one hopper for containing a road repair material to be delivered to at least one said module for filling defects; and means for conveying the repair material from said at least one hopper to said at least one module.

7. The road repair machine of claim 6, wherein said at least one hopper is modular and may be interchanged among various locations in said machine.

8. The road repair machine of claim 1, further comprising a liquid storage tank for supplying liquid to at least one said module; and means for transporting said liquid between said liquid storage tank and said at least one module.

9. The road repair machine of claim 1, wherein at least two of said at least two work modules have different functions.

10. The road repair machine of claim 9, wherein said work modules are selected from the group consisting of: radar/seismic module, sawing module, drilling module, asphalt filling module, level sensing module, sweeping module, tack coat module, concrete filling module, digging module, grinder module, rolling module, surveying module and crack and joint sealing module.

11. The road repair machine of claim 9, wherein said work modules may be interchanged among various slots, and wherein said means for controlling keeps track of positions of said respective work modules for controlling said actuation of said work modules and said movement of said work modules between working and inoperative positions.

12. The road repair machine of claim 9, wherein at least two of said work modules have different functions, said work modules being selected from the group consisting of: radar/seismic module, sawing module, drilling module, asphalt filling module, level sensing module, sweeping module, tack coat module, concrete filling module, digging module, grinder module, rolling module, surveying module and crack and joint sealing module.

13. A system for efficiently repairing road surfaces; said system comprising:

a relatively large machine including a movable vehicle having multiple slots, each defined by predetermined dimensions designed to receive a work module; multiple work modules having predetermined dimensions adapted to fit within each said slot, and wherein at least one of said modules comprises a surveying module; means for robotically moving said work modules between a working position and an inoperative position; and means for controlling said means for robotically moving and for controlling actuation of said work modules; and a relatively small machine including a movable vehicle having at least one slot defined by predetermined dimensions matching said predetermined dimensions of said slots included in said relatively large machine; wherein said surveying module may be removed from said large machine and placed in said slot of said small machine to conduct surveying operations prior to road repair, and then removed from said small machine and replaced in a slot of said large machine for use during road repair operations.

14. The system of claim 13, wherein said surveying module is a radar/seismic module.

15. A robotic, modular road repair machine comprising:

a movable vehicle having a plurality of slots, each defined by predetermined dimensions designed to receive a work module;

a plurality of work modules having predetermined dimensions adapted to fit within each said slot;

means for robotically moving said work modules between a working position and an inoperative position; and means for controlling said means for robotically moving and for controlling actuation of said at least one work module.

16. A robotic, modular road repair machine comprising:

a movable vehicle having at least one slot defined by predetermined dimensions designed to receive a work module;

at least one work module having predetermined dimensions adapted to fit within each said slot;

means for robotically moving said at least one work module between a working position and an inoperative position;

means for controlling said means for robotically moving and for controlling actuation of said at least one work module;

at least one hopper for containing a road repair material to be delivered to at least one said module for filling defects; and means for conveying the repair material from said at least one hopper to said at least one module, wherein said at least one hopper is modular and may be interchanged among various locations in said machine.

17. A robotic, modular road repair machine comprising:

a movable vehicle having at least two one slots, each defined by predetermined dimensions designed to receive a work module;

at least one work module having predetermined dimensions adapted to fit within each said slot, wherein said at least one work module may be readily removed from a first of said at least two slots and inserted into a second of said at least two slots;

means for robotically moving said at least one work module between a working position and an inoperative position; and means for controlling said means for robotically moving and for controlling actuation of said at least one work module.

* * * * *